US007862035B2

(12) United States Patent
Shiohara et al.

(10) Patent No.: US 7,862,035 B2
(45) Date of Patent: Jan. 4, 2011

(54) SHEET FEED DEVICES AND IMAGE RECORDING APPARATUS COMPRISING SUCH SHEET FEED DEVICES

(75) Inventors: Yukio Shiohara, Nagoya (JP); Tetsuo Asada, Kuwana (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 12/257,348

(22) Filed: Oct. 23, 2008

(65) Prior Publication Data

US 2009/0166954 A1 Jul. 2, 2009

(30) Foreign Application Priority Data

Dec. 28, 2007 (JP) ..... 2007-339615

(51) Int. Cl.
*B65H 3/34* (2006.01)

(52) U.S. Cl. ..... 271/167; 271/161; 271/169; 271/170

(58) Field of Classification Search ..... 271/145, 271/161, 167, 169, 170
See application file for complete search history.

(56) References Cited

U.S. PATENT DOCUMENTS

| | | | | |
|---|---|---|---|---|
| 5,456,456 | A | 10/1995 | Abe et al. | |
| 5,815,787 | A * | 9/1998 | Crayton et al. | 399/393 |
| 5,899,450 | A * | 5/1999 | Gettelfinger et al. | 271/121 |
| 6,065,886 | A * | 5/2000 | Embry et al. | 400/629 |
| 6,139,007 | A * | 10/2000 | Cahill et al. | 271/121 |
| 6,279,897 | B1 * | 8/2001 | Richards | 271/121 |
| 7,029,005 | B2 * | 4/2006 | Brock et al. | 271/121 |
| 7,092,074 | B2 * | 8/2006 | Kawai et al. | 355/407 |
| 7,204,483 | B2 * | 4/2007 | Mo et al. | 271/161 |
| 7,370,859 | B2 * | 5/2008 | Asada | 271/121 |
| 7,549,624 | B2 * | 6/2009 | Watanabe | 271/9.11 |
| 2003/0132570 | A1 * | 7/2003 | Park | 271/167 |
| 2004/0245707 | A1 * | 12/2004 | Mo et al. | 271/161 |
| 2006/0012105 | A1 * | 1/2006 | Shiohara et al. | 271/10.01 |
| 2008/0296831 | A1 * | 12/2008 | Chino | 271/145 |
| 2009/0085279 | A1 * | 4/2009 | Wakakusa et al. | 271/145 |

FOREIGN PATENT DOCUMENTS

| | | | |
|---|---|---|---|
| JP | S57-131643 | A | 8/1982 |
| JP | 2001-031264 | A | 2/2001 |
| JP | 2007-254075 | A | 10/2007 |
| JP | 2007-302355 | A | 11/2007 |

* cited by examiner

*Primary Examiner*—Stefanos Karmis
*Assistant Examiner*—Prasad V Gokhale
(74) *Attorney, Agent, or Firm*—Baker Botts L.L.P.

(57) ABSTRACT

The invention describes a sheet feed device having a sheet tray having a bottom plate defining a first portion of a storing portion that receives sheets therein, a feed roller, a separation plate, and a recessed portion formed in the separation surface. The feed roller moves to contact a sheet of the sheets, and to feed the sheet. The separation plate is disposed at a downstream end of the sheet tray and extends in a width direction. The separation plate has a separation surface which is inclined with respect to the bottom plate of the sheet tray, and defines at least a second portion of the storing portion. The recessed portion is formed in the separation surface and extends toward a downstream end of the separation surface. The separation plate is configured to separate the sheet from the sheets as the feed roller feeds the sheet.

9 Claims, 9 Drawing Sheets

SHEET FEED DEVICES AND IMAGE RECORDING APPARATUS COMPRISING SUCH SHEET FEED DEVICES

CROSS REFERENCE TO RELATED APPLICATIONS

The present application claims priority from Japanese Patent Application No. 2007-339615, which was filed on Dec. 28, 2007, the disclosure of which is incorporated herein by reference in its entirety.

BACKGROUND OF THE INVENTION

1. Field of the Invention

The invention relates generally to sheet feed devices which comprise a sheet tray configured to receive a plurality of sheets, a feed roller configured to move with respect to the sheet tray, and an inclined separation plate which cooperates with the feed roller to feed an uppermost sheet from the sheet tray toward a recording unit. The invention also relates to image recording apparatus which comprise such a sheet feed device.

2. Description of Related Art

A known sheet feed device is used in a known image recording apparatus, such as a printer or a facsimile device, or both. The known sheet feed device comprises a sheet tray configured to receive a plurality of sheets therein and a feed roller configured to move with respect to the sheet tray and feed the sheets from the sheet tray toward a recording unit. The sheet tray comprises a single side guide or a pair of side guides configured to move in a sheet widthwise direction and guide sides edges of sheets stacked in the sheet tray. A linear mark, which is parallel to an upper surface of the stacked sheets, is engraved or printed on an inner side surface of the single side guide or one of the pair of side guides, or on an inner side surface of one of side walls of the sheet tray which extend along side edges of the stacked sheets. The linear mark is used to restrict a maximum permissible load of sheets in the sheet tray.

However, when the sheet tray is configured to be detachably inserted into the image recording apparatus while the extending direction of the side walls of the sheet tray is parallel to the inserting direction, the linear mark may be difficult to be seen when viewed in the inserting direction. This may cause stacking of sheets in the sheet tray beyond the linear mark, which may result in an idle rotation of the feed roller, misfeeding of sheets, or paper jamming.

SUMMARY OF THE INVENTION

Therefore, a need has arisen for sheet feed devices and image recording apparatus that overcome these and other shortcomings of the related art. A technical advantage of the present invention is that stacking of excessive sheets may be prevented and the sheets may be fed from the sheet tray in a stable manner.

In an embodiment of the invention, a sheet feed device comprises a sheet tray comprising a bottom plate which defines at least a first portion of a storing portion, wherein the storing portion is configured to receive a plurality of sheets therein, a feed roller configured to move with respect to the storing portion, to contact an uppermost sheet of the plurality of sheets, and to feed the uppermost sheet in a sheet feed direction, a separation plate disposed at a downstream end of the sheet tray in the sheet feed direction and extending in a width direction of the sheet tray, wherein the separation plate comprises a separation surface which is inclined with respect to the bottom plate of the sheet tray, and defines at least a second portion of the storing portion, and a recessed portion formed in the separation surface and extending toward a downstream end of the separation surface in the sheet feed direction, wherein the separation plate is configured to separate the uppermost sheet from the plurality of sheets as the feed roller feeds the uppermost sheet in the sheet feed direction, and wherein the width direction is substantially perpendicular to the sheet feed direction.

In another embodiment of the invention, a sheet feed device comprises a sheet tray comprising a bottom plate which defines at least a first portion of a storing portion, wherein the storing portion is configured to receive a plurality of sheets therein, a feed roller configured to move with respect to the storing portion, to contact an uppermost sheet of the plurality of sheets, and to feed the uppermost sheet in a sheet feed direction, a separation plate disposed at a downstream end of the sheet tray in the sheet feed direction and extending in a width direction of the sheet tray, wherein the separation plate comprises a separation surface which is inclined with respect to the bottom plate of the sheet tray, and defines at least a second portion of the storing portion, and a pair of recessed portions formed in the separation surface and disposed on the separation surface at positions corresponding to edges of a shorter-side dimension of the plurality of sheets, wherein the pair of recessed portions extend toward a downstream end of the separation surface in the sheet feed direction, wherein the separation plate is configured to separate the uppermost sheet from the plurality of sheets as the feed roller feeds the uppermost sheet in the sheet feed direction, and wherein the width direction is substantially perpendicular to the sheet feed direction.

In still another embodiment of the invention, an image recording apparatus comprises a sheet feed device comprising a sheet tray comprising a bottom plate which defines at least a first portion of a storing portion, wherein the storing portion is configured to receive a plurality of sheets therein, a feed roller configured to move with respect to the storing portion, to contact an uppermost sheet of the plurality of sheets, and to feed the uppermost sheet in a sheet feed direction, a separation plate disposed at a downstream end of the sheet tray in the sheet feed direction and extending in a width direction of the sheet tray, wherein the separation plate comprises a separation surface which is inclined with respect to the bottom plate of the sheet tray, and defines at least a second portion of the storing portion, and a recessed portion formed in the separation surface and extending toward a downstream end of the separation surface in the sheet feed direction. The image recording apparatus also comprises a recording unit configured to record an image on the plurality of sheets fed by the feed roller, wherein the separation plate is configured to separate the uppermost sheet from the plurality of sheets as the feed roller feeds the uppermost sheet in the sheet feed direction, and wherein the width direction is substantially perpendicular to the sheet feed direction.

Other advantages of the present invention will be apparent to persons of ordinary skill in the art in view of the following detailed description of the invention and the accompanying drawings.

BRIEF DESCRIPTION OF THE DRAWINGS

For a more complete understanding of the present invention, and the needs satisfied thereby, reference now is made to the following descriptions taken in connection with the accompanying drawings.

DETAILED DESCRIPTION OF EMBODIMENTS

Embodiments of the present invention may be understood by referring to FIGS. 1-8D, like numerals being used for like corresponding parts in the various drawings.

Figure 1:
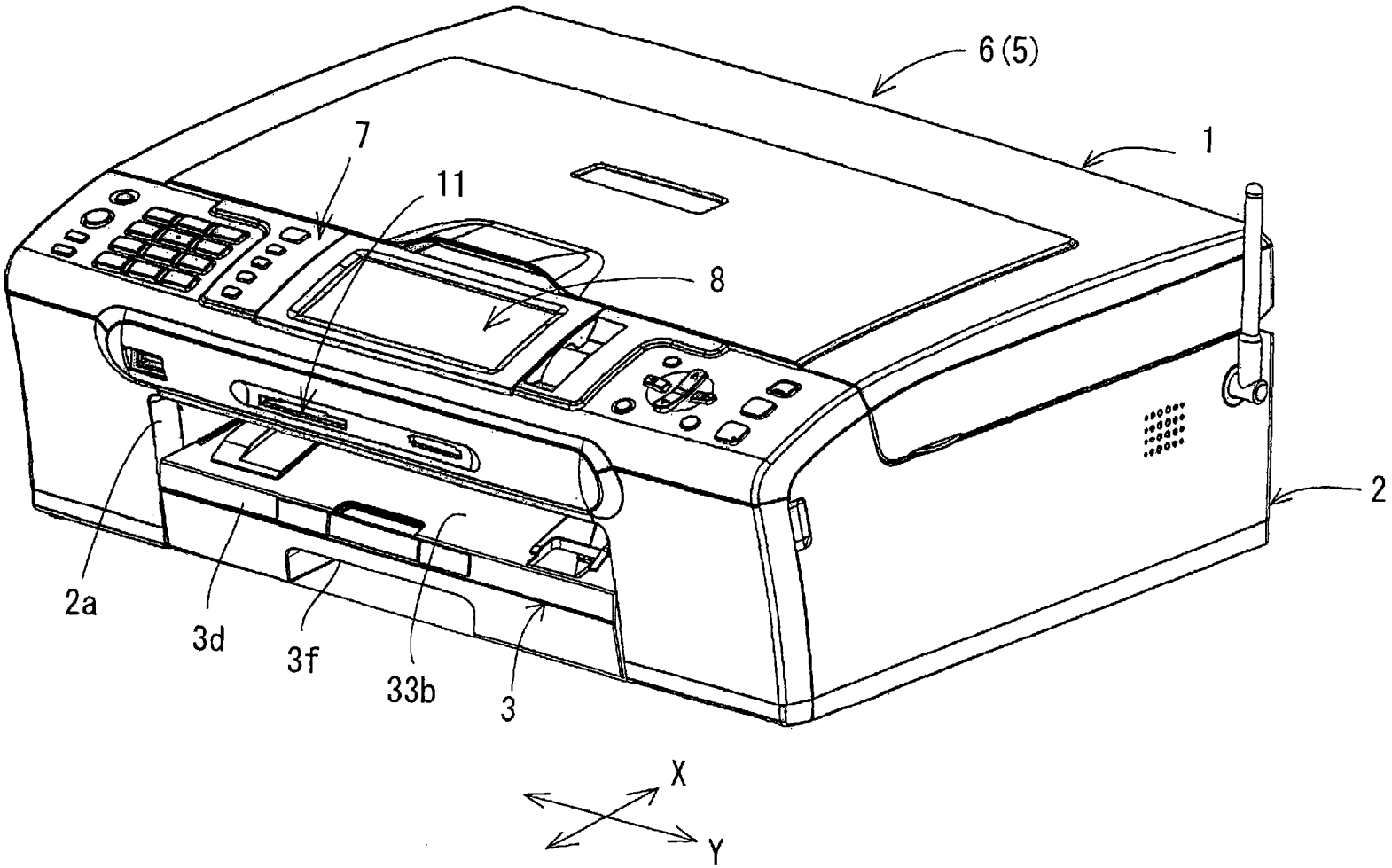
FIG. 1 is a perspective view of an image recording apparatus, according to an embodiment of the invention.

FIG. 1 shows an image recording apparatus 1 according to an embodiment of the present invention. The image recording apparatus 1 may be a multi-function device ("MFD") that has printing, copying, scanning, or facsimile functions, or any combination thereof. As shown in FIG. 1, the image recording apparatus 1 may comprise a housing 2. An opening 2*a* may be formed in the front of the housing 2. A sheet tray 3 may be mounted in the opening 2*a*, such that the sheet tray 3 may be selectively inserted into and removed from the opening 2*a* in an X-axis direction with side plates 3*c* of the sheet tray 3 parallel to the inserting/removing direction. A discharge tray 33 is may be disposed on the sheet tray 3. Hereinafter, a side in which the opening 2*a* is located is referred to as a "front" side of the image recording apparatus 1, and a side opposite the opening 2*a* is referred to as a "rear" side of the image recording apparatus 1.

An image reading device 5 may be disposed, on an upper portion of the housing 2, for reading a document during a copying and/or a facsimile operation of the image recording apparatus 1. The image reading device 5 may be vertically pivotable about a pivot located at one end of the housing 2. A glass plate may be disposed at the top of the image reading device 5, and may be covered by a document cover 6 which may be vertically pivotable about a pivot located at a rear end of the image reading device 5. A document may be disposed on the glass plate by opening the document cover 6 upward. A scanner, e.g., a contact image sensor, may read an image of the document while reciprocating under the glass plate in a main scanning direction, e.g., a Y-axis direction.

An operation panel 7 may be disposed at the top of the housing 2, on a front side of the image reading device 5, and may comprise a plurality of operation buttons and a display device 8, e.g., a liquid crystal display. The operation buttons may comprise a start button (not shown) and a stop button (not shown), which may be selected to execute various operations. The display device 8 may display setting conditions of the image recording apparatus 1 and operation messages.

A memory slot 11 for receiving external memories may be disposed at the front of the housing 2, on an upper side of the opening 2*a*. The external memories may be, for example, a Compact Flash®, a Smart Media®, a Memory Stick®, a SD Card®, and/or a xD Card®. Data stored in an external memory inserted in the memory slot 11 may be read into an internal memory of the image recording device 1, and may be printed on a sheet by a recording unit 10.

Figure 2:
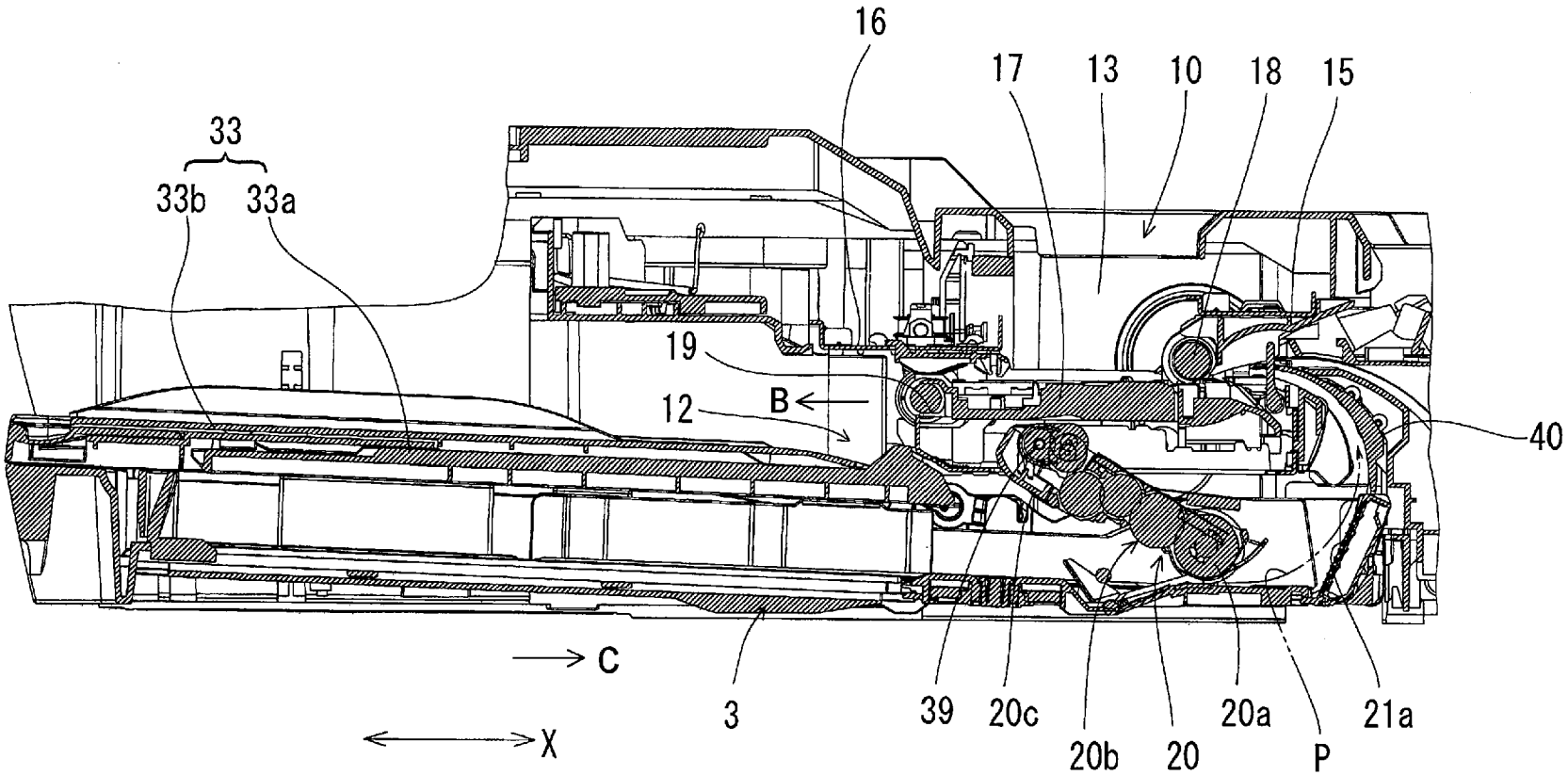
FIG. 2 is a side, cross-sectional view of a recoding unit and a sheet feed device of the image recording apparatus of FIG. 1.

As shown in FIG. 2, the recording unit 10 may be defined by a main frame (not shown) having an upwardly open box structure, and a first guide member 15 and a second guide member 16 which comprise elongate plates which are supported by side plates of the main frame and extend in the main scanning direction. A carriage 13, on which a recording head (not shown) of the recording unit 10 may be mounted, may be supported by the first guide member 15 disposed upstream of the carriage 13 in a sheet discharge direction (indicated by arrow B) and the second guide member 16 disposed downstream of the carriage 13, such that the carriage 13 may be slidably movable on the first guide member 22 and the second guide member 23. Thus, the carriage 13 may be reciprocally movable in the Y-axis direction.

In order to reciprocally move the carriage 13, a timing belt (not shown) may be disposed on an upper surface of the second guide member 16. The timing belt extends in the Y-axis direction and may be wound around pulleys (not shown). A carriage motor (not shown) configured to drive the timing belt may be fixed to a lower surface of the second guide member 16.

A platen 17 may have a flat shape and may extend in the Y-axis direction to face an underside of the recording head on the carriage 13. The platen 17 may be fixed above a bottom plate of the main frame between the first guide member 15 and the second guide member 16.

A pair of register rollers (convey rollers) 18 may be disposed upstream of the platen 17 in the sheet discharge direction to feed the sheet to the underside of the recording head, and a pair of discharge rollers 19 may be disposed downstream of the platen 17 to discharge the printed sheet to the discharge tray 33 disposed on the sheet tray 3. The platen 17 supports the sheet conveyed by the register rollers 18, such that a distance between the sheet and the recording head may be maintained constant.

Sheet tray 3 may store various types of recording media, including, e.g., plain paper, cardboard postcards and envelopes, specialized paper, e.g., coated paper, resin films, and the like. In a sheet feed device 12, the sheet tray 3 may be made of synthetic resin by injection molding and may comprise a first portion, e.g., an inner storing portion 3*b* and an outer storing portion 3*d* connected to the inner storing portion. The outer storing portion 3*d* may be moved closer to and away from the inner storing portion 3*b*. When the outer storing portion 3*d* is moved away from the inner storing portion 3*b*, e.g., to increase the X-axis dimension of the sheet tray 3, a plurality of sheets, e.g., A3-sized sheets, may be stored in the inner sheet storing portion 3*b* and the outer sheet storing portion 3*d*. In this configuration, the plurality of sheets may have their longer sides extending in the X-axis direction and their shorter sides extending in the Y-axis direction.

When the outer storing portion 3*d* is moved toward the inner storing portion 3*b*, e.g., to reduce the X-axis dimension of the sheet tray 3, a plurality of sheets, e.g., A4-sized sheets may be stored in the sheet tray 3. A pendulum-type feed unit 20 sequentially may feed the sheets one at a time from the sheet tray 3 toward the recording unit 10.

The inner storing portion 3*b* may be defined by a bottom plate 3*a*, the opposed side plates 3*c* extending in the X-axis direction, and a separation plate 21 disposed at a downstream end of the sheet tray 3 in a sheet feed direction, e.g., the direction indicated by arrow C in FIG. 2. The separation plate 21 may extend in the Y-axis direction and may have a front surface which may be inclined with respect to the bottom plate 3*a*, and which may face the inner storing portion 3*b*. The outer storing portion 3*d* may be defined by a bottom plate (not shown), opposed side plates (not shown) and a handle portion 3*f* disposed at an upstream end of the sheet tray 3 in the sheet feed direction. The maximum permissible load of sheets in the sheet tray 3 may be about 150 sheets of plain paper, or a stack of sheets having a height of about 15 mm.

Figure 3:
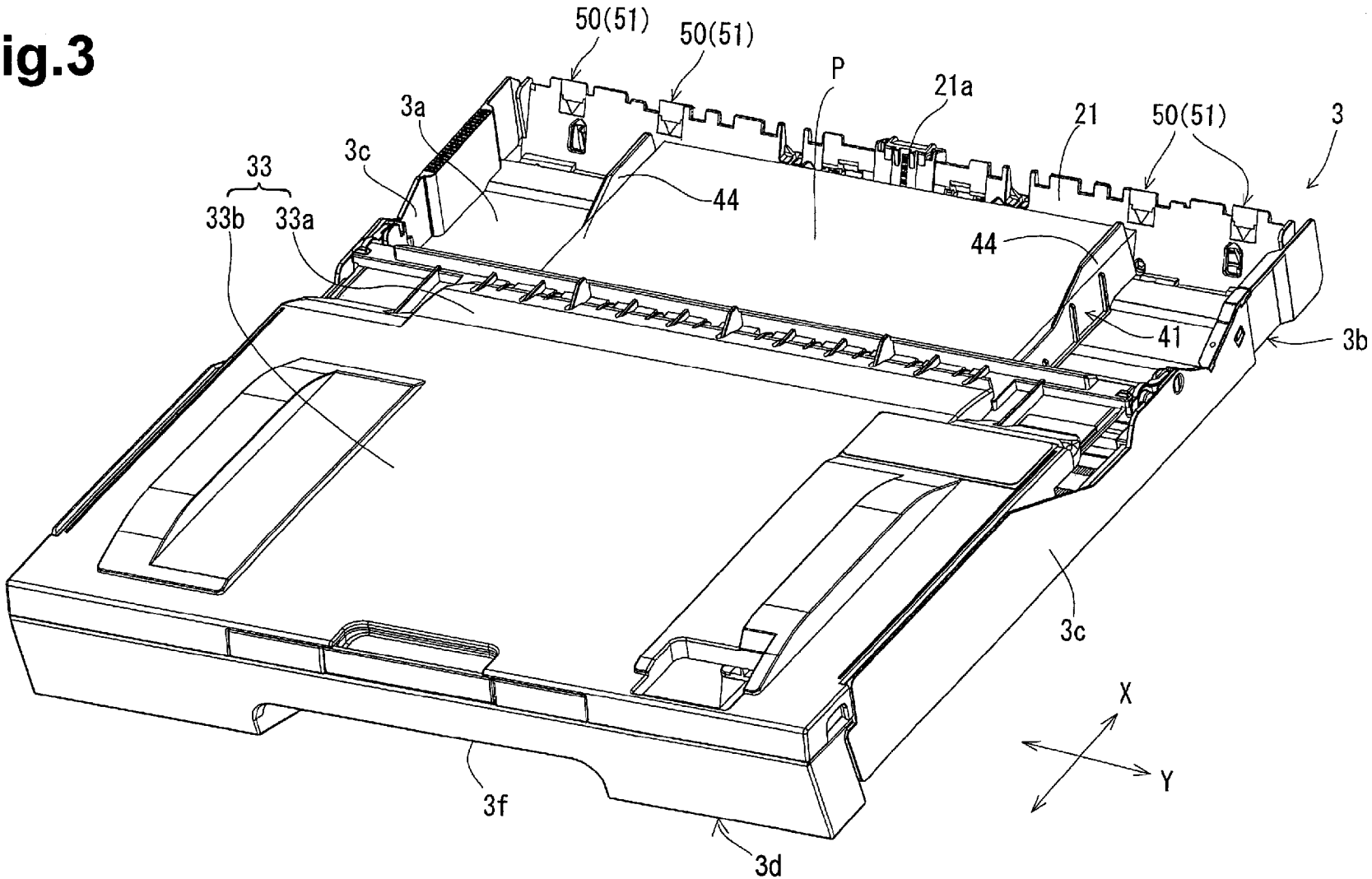
FIG. 3 is a perspective view of a sheet tray of the sheet feed device of FIG. 2.

The discharge tray 33 may be made of synthetic resin by injection molding, and may comprise an inner receiving portion 33*a* connected to the sides plates 3*c*, such that the discharge tray may be vertically pivotable, and an outer receiving portion 33*b* may be connected to the inner receiving portion 33*a*, such that the outer receiving portion 33*b* may move closer to and away from the inner receiving portion 33*a*. As shown in FIG. 3, the outer receiving portion 33*b* may be horizontally disposed on the opposed side plates of the outer storing portion 3*d*, and outer storing portion 3*d* and outer receiving portion 33*b* may be extendable together from the opening 2*a*.

Figure 4:
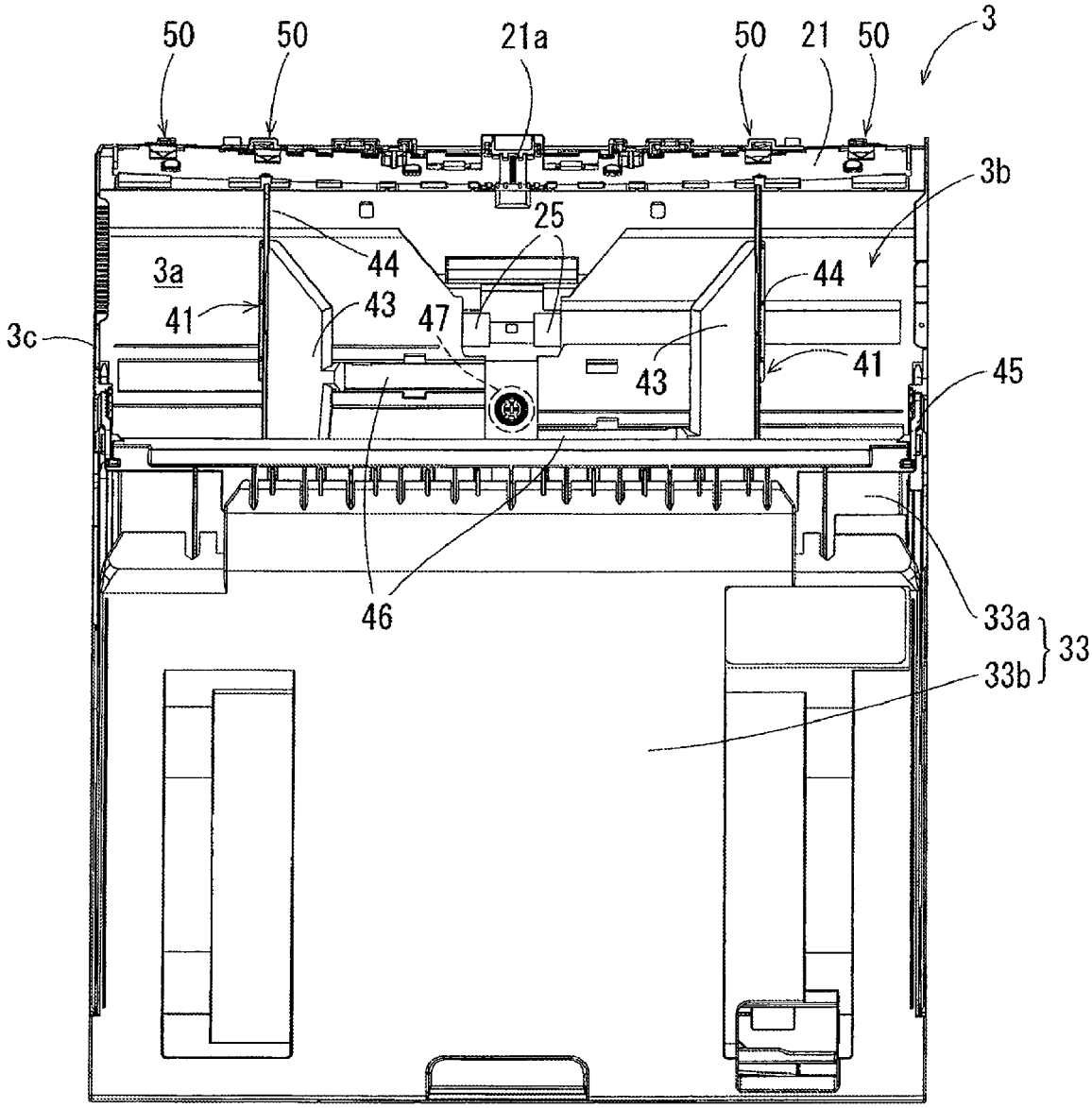
FIG. 4 is a plan view of the sheet tray of the sheet feed device of FIG. 2.

As shown in FIGS. 3 and 4, the inner storing portion 3*b* of the sheet tray 3 may comprise a pair of side guides 41 and a tail guide (not shown). The side guides 41 extend in the sheet feed direction (X-axis direction), and may position and guide side edges of the sheets disposed in the sheet tray 3. The tail guide may be movable in the X-axis direction so as to position trailing edges of the sheets.

The side guides 41 may be slidable, such that the distance therebetween selectively is increased and decreased. Racks 46 connected to the side guides 41 may engage a pinion 47 disposed at a widthwise center (center in the Y-axis direction) of the sheet tray 3. Thus, the distance between the side guides 41 may be adjusted, such that a widthwise centerline of the sheet tray 3 aligns with a widthwise centerline of the sheets. Each of the side guides 41 may comprise a slider 43 and a stopper 44. Each slider 43 may be slidable in the Y-axis direction and supports a lower surface of the sheets. The stopper 44 stands upright, and may contact the side edges of the sheets.

One of the side guides may comprise a lock member (not shown) with a handle 45. The lock member may be configured to engage one of teeth formed in the upper surface of the bottom plate 3*a*. When the handle 45 is operated, the lock member may be released from the bottom plate 3*a*.

As shown in FIG. 2, the feed unit 20 may comprise an arm 20*c* which may be vertically pivotable about a drive shaft 39. The arm 20*c* may extend toward the separation plate 21. A pair of feed rollers 20*a* may be disposed at a free end of the arm 20*c*, and may be driven by the drive shaft 39 via a gear transmission mechanism 20*b*. The feed rollers 20*a* may contact and feed the uppermost sheet of the sheets in the sheet tray 3.

A pair of friction members 25 may be fixed to an upper surface of the bottom plate 3*a* of the sheet tray 3 to receive the pair of feed rollers 20*a* when the arm 20*c* pivots downward. This prevents two or more sheets from being fed together by the feed rollers 20*a* when only a small number of sheets remain in the sheet tray 3.

Referring again to FIG. 3, a front surface of the separation plate 21 may have a convex shape, such that a widthwise center, e.g., a Y-axis center, thereof may project, e.g., extend, toward the leading edges of the sheets in the storing portion. Similarly, widthwise ends, e.g., Y-axis ends, thereof may retract away from the leading edges of the sheets in the storing portion. A separation member 21*a* may have a sawtooth shape, and may be disposed at the widthwise center (Y-axis center) of the front surface of the separation plate 21. In this case, a widthwise center of the leading edge of the sheet fed by the feed rollers 20*a* contacts the separation member 21*a* before widthwise ends of the leading edge of the sheet contact the front surface of the separation plate 21. This may ensure a reliable separation of the sheet.

The feed rollers 20*a* may feed the sheets one at a time from the sheet tray 3 along with the separation member 21*a*, which may be made from a metal spring. The sheets may be fed via the convey path member 40, to the recording unit 10 located above the sheet feed tray 3. The sheet may make a U-turn along the convey path member 40. The sheet recorded thereon may be discharged toward the opening 2*a*, with the recorded surface facing upward.

The separation plate 21 may comprise a mark portion 50 which may be recessed in the front surface of the separation plate 21 and which may indicate the maximum permissible load of sheets in the sheet tray 3, e.g., the maximum number of sheets that sheet tray 3 may be configured to receive. The maximum permissible load of sheets means a maximum number of sheets or a maximum height of a stack of sheets that may allow for the feed rollers 20*a* and the separation plate 21 to feed the sheets in a stable manner without causing a potential malfunction, e.g., an idle rotation of the feed rollers 20*a*, feeding of no sheet, feeding of a plurality of sheets at a time, skewing of sheets, paper jamming, or the like.

When excessive sheets are stored in the sheet tray 3, an angle of inclination of the arm 20*c* with respect to an upper surface of the sheets may decrease, and a contact force applied by the feed rollers 20*a* on the sheets also may decrease. The contact force may drop such that a sheet drawing force associated with the feed rollers 20*a* also may decrease enough to result in an idle rotation of the feed roller, e.g., a failure to feed a sheet. The angle of inclination of the arm 20*c* may be formed between an upper surface of the sheets and a line which connects a point at which each of the feed rollers 20*a* contacts the upper surface of the sheets and the pivot center of the arm 20*c*. The maximum permissible load of sheets in the sheet tray 3 may be selected to ensure a stable sheet feeding based on the configuration specifications of the printer.

As shown in FIGS. 3-6, the mark portion 50 may be formed as a recessed portion 51 in the front surface of the separation plate 21 and may have a rectangular shape when viewed from an upstream side of the sheet tray 3 in the sheet feed direction. The recessed portion 51 may extend in a downstream side of the separation plate 21 until the recessed portion 51 reaches the downstream end of the separation plate 21, and may extend by about one-third of the length of separation plate 21 in the sheet feed direction of the separation plate 21. The recessed portion 51 may be enclosed by three side walls, and may be open at the downstream end of the separation plate 21. A lower edge 51*a* of the recessed portion 51, e.g. an upstream edge of the recessed portion 51 in the sheet feed direction, may be formed on the separation plate 21 at a position corresponding to the maximum permissible load of sheets in the sheet tray 3.

Recessed portion 51 may be disposed such that the position of the lower edge 51*a* may be at a height H1 from the bottom plate 3*a*. The lower edge 51*a* may correspond to the lowest position of the recessed portion 51. When the sheets are stacked within sheet tray 3, if lower edge 51*a* is visible, the stacked sheets may not exceed the maximum permissible load of sheets in the sheet tray 3, and malfunctions, e.g., misfeeding of sheets may be less likely to occur.

Figure 5:
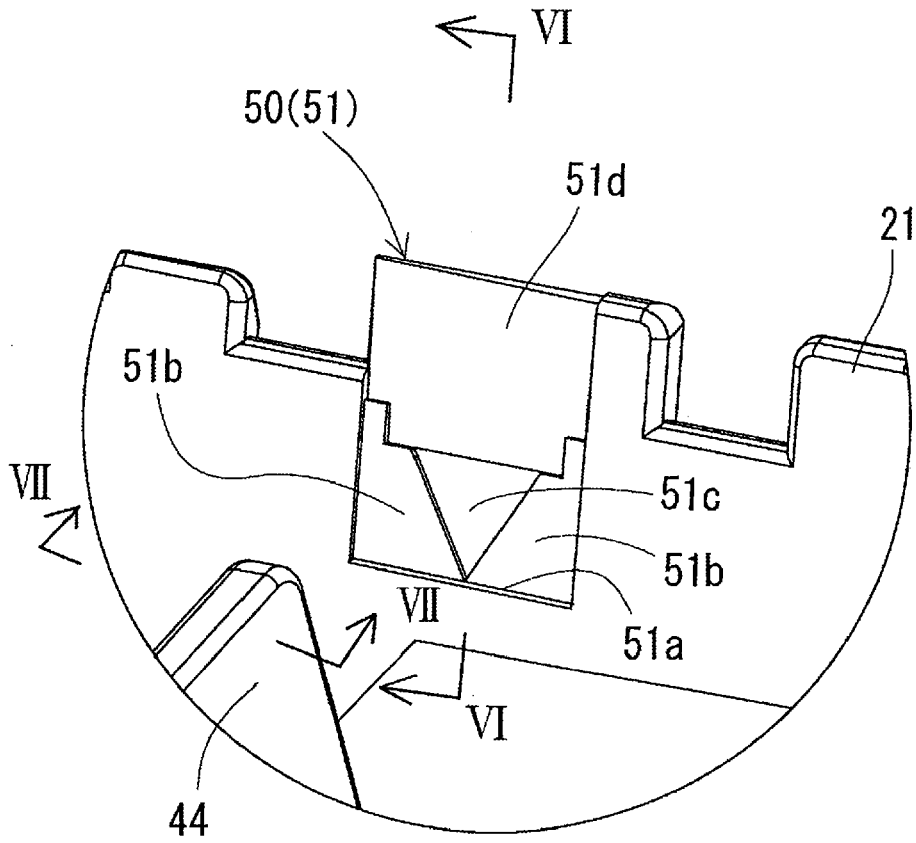
FIG. 5 is an enlarged perspective view of a mark portion of the sheet tray of FIG. 3.

As shown in FIG. 5, the recessed portion 51 may be formed at three levels, e.g., heights of sub-portions. Each of a pair of first level portions 51*b* may have a substantially right triangular shape, having the lower edge 51*a* as a lower side and one side of the recessed portion 51*a* as a vertical side. The pair of first level portions 51*b* may be symmetrical with respect to a centerline therebetween. A second level portion 51*c* may be formed between the pair of first level portions 51*b* and may have an acute angle which may form a point at the lower edge 51*a*. A third level portion 51*d* may be formed above the first level portions 51*b* and the second level portion 51*c* and may have a substantially rectangular shape.

Figure 6:
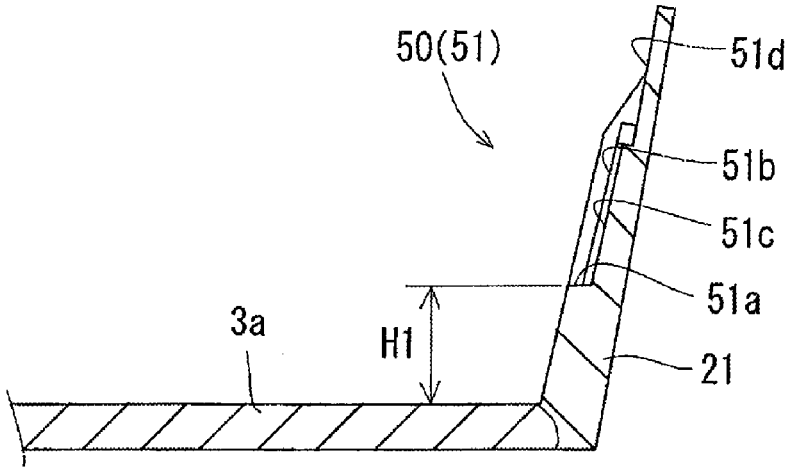
FIG. 6 is a cross-sectional view of the mark portion taken along line VI-VI of FIG. 5.

As shown in FIG. 6, the depth from the front surface of the inclined separation panel 21 may increase toward the downstream end of the separation surface, e.g., the inclined surface, in the sheet feed direction, e.g., in the order of the first level portions 51*b*, the second level portion 51*c*, and the third level portion 51*d*.

The horizontal lower edge 51*a* and the acute angle of the second level portion 51*c* which may form the point at the horizontal lower edge 51*a*, which may indicate the maximum permissible load of sheets in the sheet tray 3, may easily be viewed by an operator when the operator supplies sheets into the sheet tray 3 while facing the front surface of the separation plate 21. The horizontal lower edge 51*a* and the acute angle of the second level portion 51*c* which may form the point at the horizontal lower edge 51*a* also easily may be viewable when the operator inserts the sheet tray 3 into the housing 2 through the opening 2*a*, with the front surface of the separation plate facing toward the opening 2*a*.

As shown in FIG. 3, a plurality of mark portions 50 may be formed in the front surface of the separation plate 21. A pair of mark portions 50, and another pair of mark portions 50 may be disposed closer to the widthwise ends, e.g., the Y-axis ends, of the front surface than to the widthwise center, e.g., the Y-axis center, of the front surface. In other words, a pair of mark portions 50 may be disposed to correspond to edges of a shorter-side dimension of the A4-sized sheet, and another pair of mark portions 50 may be disposed adjacent to inner surfaces of the side plates 3*c* of the sheet tray 3 to correspond to edges of a shorter-side dimension of an A3-sized sheet.

Figure 7:
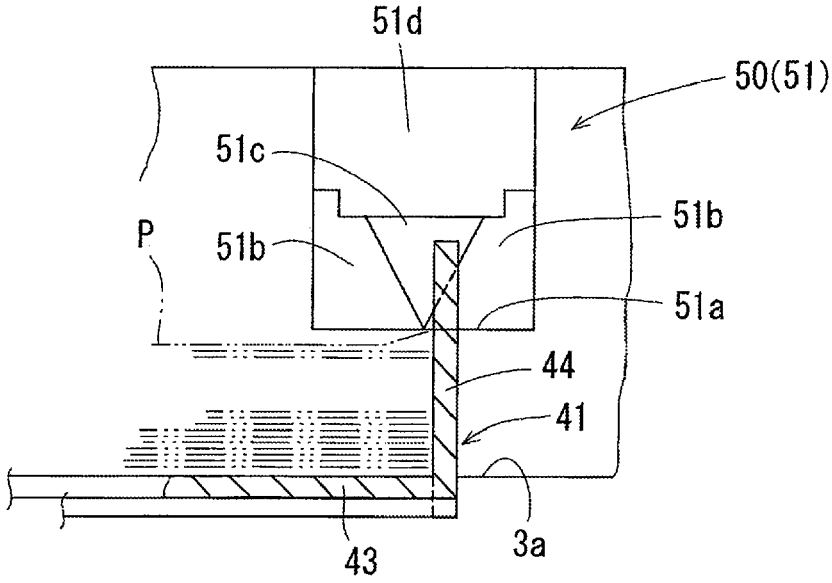
FIG. 7 is a cross-sectional view of a side guide taken along line VII-VII of FIG. 5.

The stopper of each of the pair of side guides 44 may have a contact surface which may face side edges of the sheets in the sheet tray 3. As shown in FIG. 7, when the side guides 44 are moved in a sheet widthwise direction, e.g., the Y-axis direction, and the contact surface of the stopper 44 of each of the side guides 44 contacts side edges of the sheets, the stopper 44 may oppose a corresponding one of the mark portions 50 such that the contact surface is perpendicular to a horizontal line corresponding to the lower edge 51*a* of the mark portion 50. If the length of the lower edge 51*a* is set to a predetermined length, e.g., about 20 mm, the pair of mark portions 50 may be disposed on the front surface of the separation plate 21 at positions corresponding to edges of a shorter-side dimension of A4-sized sheets and legal-sized sheets which are about 6 mm longer in the shorter-side dimension than A4-sized sheets.

Although not shown in the figure, another pair of mark portions 50 may be formed at positions closer to the separation member 21*a*, which may be located at the widthwise center of the front surface of the separation plate 21, such that the another pair of mark portions 50 may correspond to edges of a shorter side dimension of smaller sheets than A4-sized sheets, e.g. postcards, L-sized photo paper, and the like.

As shown in FIG. 7, even in instances in which the sheet P may have a corner curled upward or downward, or a corner having cutting burrs, and when the leading edge of the sheet P may abut the front surface of the separation plate 21, the sheet P yet may be likely to be fed toward a convey path member 40 without interference between the curled portion or the burrs and the recessed portion 51. This is because the mark portion 50, and the recessed portion 51 may be recessed from the front surface of the separation plate 21, and because the recessed portion 51 may extend to the downstream end of the front surface of the separation plate 21. Accordingly, the mark portion 50 and the recessed portion 51 are unlikely to cause paper jamming.

In addition, when the front surface of the separation plate 21 is convex, such that the widthwise center, e.g., the Y-axis center, thereof projects toward the storing portion of the sheet tray 3 and the widthwise ends, e.g., the Y-axis ends, thereof retract away from the storing portion, the corner of the sheet P may be less likely to interfere with the recessed portion 51.

When the separation plate 21 is made of synthetic resin by injection molding, the mark portions 50 and recessed portions 51 may be formed integrally and simultaneously with the separation plate 21, thereby reducing the manufacturing cost of the mark portions 50 and recessed portions 51.

Figure 8A:
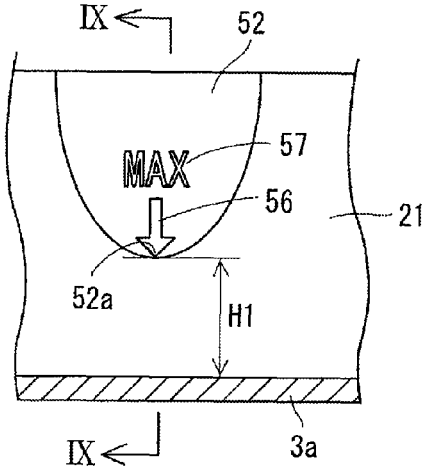
FIG. 8A is a front view of a mark portion according to another embodiment of the invention.

FIGS. 8A, 8B, 8C, and 8D show mark portions, e.g., recessed portions 52 according to other embodiments of the invention. In another embodiment of the invention, as shown in FIG. 8A, a recessed portion 52 may have a half-ellipse shape when viewed from an upstream side of the sheet tray 3 in the sheet feed direction. The recessed portion 52 may gradually widen, e.g., increase in width, toward a downstream end of the front surface of the separation plate 21. A lower edge 52*a* may be defined by a lower edge of a downward convex end of the half-ellipse. The height H1 from the bottom plate 3*a* of the sheet tray 3 to the lower edge 52*a* may correspond to the maximum permissible load of sheets in the sheet tray 3, similarly to the above-described embodiment. An arrow mark 56 pointing the lower edge 52*a* and a letter mark 57 spelling "MAX" may be formed, e.g., engraved, on a recessed surface of the recessed portion 52 to indicate the maximum permissible load of sheets. These marks allow the operator to immediately recognize the maximum permissible load of sheets.

Figure 9:
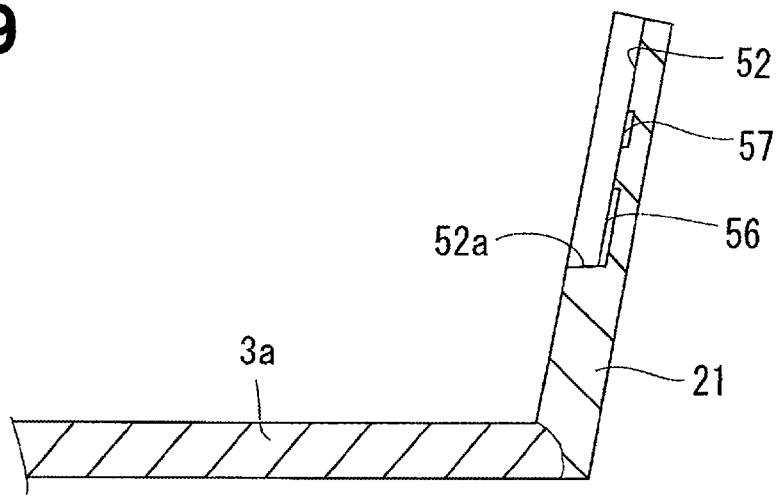
FIG. 9 is a cross-sectional view of the mark portion taken along line IX-IX of FIG. 8A.

As shown in FIG. 9, the recessed portion 52 may extend to a downstream end of the front surface of the separation plate 21, and the marks 56, 57 may be recessed from the front surface of the separation plate 21, such that the marks 56, 57 may not contact a leading edge of the sheet to be fed. Even when the sheet to be fed has a corner curled upward or downward, or a corner having cutting burrs, the sheet is likely to be fed toward the U-turn convey path 40 without interference between the curled portion or the burrs and the recessed portion 52. Accordingly, similarly to the above-described recessed portion 51, the recessed portion 52 is unlikely to cause paper jamming.

Figure 8B:
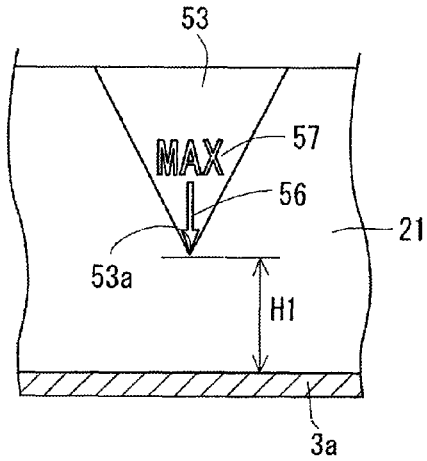
FIG. 8B is a front view of a mark portion according to yet another embodiment of the invention.
Figure 8C:
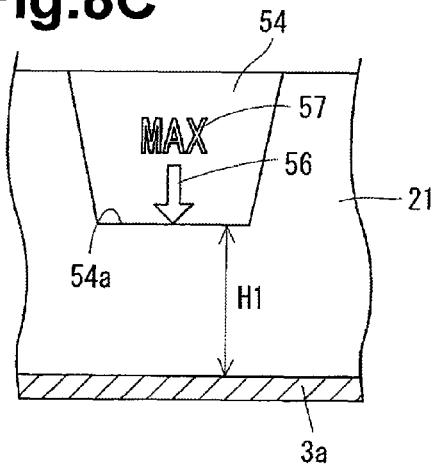
FIG. 8C is a front view of a mark portion according to still another embodiment of the invention.
Figure 8D:
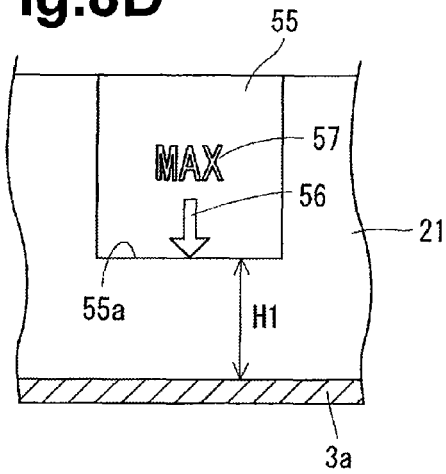
FIG. 8D is a front view of a mark portion according to a further embodiment of the invention.

As shown in FIG. 8B, a recessed portion 53 also may have an inverted triangle shape when viewed from an upstream side of the sheet tray 3 in the sheet feed direction. The recessed portion 53 may gradually widen, e.g., increase in width, toward a downstream end of the front surface of the separation plate 21. As shown in FIG. 8C, a recessed portion 54 may have a trapezoid shape, having a lower side shorter than an upper side, when viewed from an upstream side of the sheet tray 3 in the sheet feed direction. As shown in FIG. 8D, a recessed portion 55 may have a rectangular shape when viewed from an upstream side of the sheet tray 3 in the sheet feed direction.

A lower edge, e.g., lower edge 53*a*, 54*a*, or 55*a* may correspond to the maximum permissible load of sheets in the sheet tray 3. An arrow mark 56 may point to the lower edge, e.g., lower edge 53*a*, 54*a*, or 55*a*, and a letter mark 57 spelling "MAX" may be formed, e.g., engraved on a recessed surface of the recessed portion, e.g., recessed portion 53, 54, or 55. The recessed portion, e.g., recessed portion 53, 54, or 55, may extend to a downstream end of the front surface of the separation plate 21, and the marks 56, 57 may be recessed from the front surface of the separation plate 21 such that the marks may not contact a leading edge of the sheet to be fed. Accordingly, similarly to the above-described recessed portion 51, the recessed portion, e.g., recessed portion 53, 54, or 55, may be unlikely to cause paper jamming.

The recessed portion, e.g., recessed portions 52, 53, 54, or 55, may be formed in the front surface of the separation plate 21 such that when the side guide 41 is moved to be adjusted to a particular width of the sheets, the stopper 44 opposes the recessed portion, e.g., recessed portions 52, 53, 54, or 55, and the contact surface of the stopper 44 may be perpendicular to a horizontal line passing the lower edge, e.g., lower edge 52*a* or 53*a*, of the recessed portion, e.g., recessed portion 52 or 53, or may be perpendicular to the lower edge, e.g., lower edge 54*a* or 55*a* of the recessed portion, e.g., recessed portion 54 or 55.

The mark portions, e.g., the recessed portions, may be formed at more than four portions in pairs corresponding to widthwise ends of each size of sheets usable in the sheet tray.

Alternatively, a single mark portion, e.g., the recessed portion, or a single pair of mark portions, e.g., the recessed portions, may be formed at a position or positions which may be relatively close to the widthwise center of the front surface of the separation plate. The mark portion(s) in such position (s) may be used commonly for small sheets and large sheets when the sheet tray is of a center registration type in which a widthwise centerline of the sheet tray may align with a widthwise centerline of the sheets.

While the invention has been described in connection with preferred embodiments, it will be understood by those of ordinary skill in the art that other variations and modifications of the preferred embodiments described above may be made without departing from the scope of the invention. Other embodiments will be apparent to those skilled in the art from a consideration of the specification or practice of the invention disclosed herein. It is intended that the specification and the described examples only are considered as exemplary of the invention, with the true scope of the invention being defined by the following claims.

What is claimed is:

1. A sheet feed device comprising:

a sheet tray comprising a bottom plate which defines at least a first portion of a storing portion, wherein the storing portion is configured to receive a plurality of sheets therein;

a feed roller configured to move with respect to the storing portion, to contact an uppermost sheet of the plurality of sheets, and to feed the uppermost sheet in a sheet feed direction;

a separation plate disposed at a downstream end of the sheet tray in the sheet feed direction and extending in a width direction of the sheet tray, wherein the separation plate comprises a separation surface which is inclined with respect to the bottom plate of the sheet tray, and defines at least a second portion of the storing portion; and at least one recessed portion formed in the separation plate at a position separated from a center of the separation surface in the width direction of the sheet tray, wherein the at least one recessed portion is recessed from the separation surface and extends to a downstream end of the separation plate in the sheet feed direction, wherein a portion of the separation surface is interposed between the at least one recessed portion and an upstream end of the separation plate in the sheet feed direction, wherein the separation plate is configured to separate the uppermost sheet from the plurality of sheets as the feed roller feeds the uppermost sheet in the sheet feed direction, and wherein the width direction is substantially perpendicular to the sheet feed direction, wherein the recessed portion comprises a first sub-portion and a second-sub portion positioned downstream of the first sub-portion in the sheet feed direction, and wherein the second sub-portion extends to the downstream end of the separation plate, and a depth of the second sub-portion from the separation surface is greater than a depth of the first sub-portion from the separation surface.

2. A sheet feed device comprising:

a sheet tray comprising a bottom plate which defines at least a first portion of a storing portion, wherein the storing portion is configured to receive a plurality of sheets therein;

a feed roller configured to move with respect to the storing portion, to contact an uppermost sheet of the plurality of sheets, and to feed the uppermost sheet in a sheet feed direction;

a separation plate disposed at a downstream end of the sheet tray in the sheet feed direction and extending in a width direction of the sheet tray, wherein the separation plate comprises a separation surface which is inclined with respect to the bottom plate of the sheet tray, and defines at least a second portion of the storing portion; and at least one recessed portion formed in the separation plate at a position separated from a center of the separation surface in the width direction of the sheet tray, wherein the at least one recessed portion is recessed from the separation surface and extends to a downstream end of the separation plate in the sheet feed direction, wherein a portion of the separation surface is interposed between the at least one recessed portion and an upstream end of the separation plate in the sheet feed direction, wherein the separation plate is configured to separate the uppermost sheet from the plurality of sheets as the feed roller feeds the uppermost sheet in the sheet feed direction, and wherein the width direction is substantially perpendicular to the sheet feed direction, wherein a width of the at least one recessed portion increases from an upstream edge to a downstream edge of the at least one recessed portion in the sheet feed direction.

3. A sheet feed device comprising:

a sheet tray comprising a bottom plate which defines at least a first portion of a storing portion, wherein the storing portion is configured to receive a plurality of sheets therein;

a feed roller configured to move with respect to the storing portion, to contact an uppermost sheet of the plurality of sheets, and to feed the uppermost sheet in a sheet feed direction;

a separation plate disposed at a downstream end of the sheet tray in the sheet feed direction and extending in a width direction of the sheet tray, wherein the separation plate comprises a separation surface which is inclined with respect to the bottom plate of the sheet tray, and defines at least a second portion of the storing portion; and at least one recessed portion formed in the separation plate at a position separated from a center of the separation surface in the width direction of the sheet tray, wherein the at least one recessed portion is recessed from the separation surface and extends to a downstream end of the separation plate in the sheet feed direction, wherein a portion of the separation surface is interposed between the at least one recessed portion and an upstream end of the separation plate in the sheet feed direction, wherein the separation plate is configured to separate the uppermost sheet from the plurality of sheets as the feed roller feeds the uppermost sheet in the sheet feed direction, and wherein the width direction is substantially perpendicular to the sheet feed direction, wherein a position of an upstream edge of the at least one recessed portion in the sheet feed direction corresponds to a predetermined number of sheets in the storing portion.

4. The sheet feed device according to claim 3, wherein the predetermined number of sheets is a maximum number of sheets which the sheet tray is configured to receive.

5. The sheet feed device according to claim 3, wherein the at least one recessed portion comprises:

a recessed surface recessed from the separation surface; and a mark formed on the recessed surface, wherein the mark comprises at least one of a letter and a sign.

6. The sheet feed device according to claim 3, wherein the at least one recessed portion comprises a pair of recessed portions formed in the separation plate at positions separated from the center of the separation surface in the width direction of the sheet tray, wherein the pair of recessed portions extend to the downstream end of the separation plate in the sheet feed direction.

7. The sheet feed device according to claim 6, wherein the separation surface is convex, and the center of the convex separation surface in the width direction of the sheet tray protrudes toward the sheet storing portion and opposite ends of the convex separation surface in the width direction of the sheet tray retract away from the storing portion, and wherein the pair of recessed portions are formed in the separation plate at positions closer to respective opposite ends of the separation surface than to the center of the separation surface.

8. The sheet feed device according to claim 6, wherein the sheet tray comprises a pair of side guides, wherein each side guide comprises a contact surface and is configured to move in the width direction of the sheet tray, and wherein when each of the contact surfaces of the pair of side guides contacts side edges of the plurality of sheets, each of the side guides also opposes a corresponding one of the recessed portions, such that each contact surface is perpendicular to a horizontal line formed by an upstream edge of respective recessed portions.

9. The sheet feed device according to claim 3, further comprising an arm having a first end and a second end opposite the first end, wherein the arm is configured to pivot about the first end, and wherein the feed roller is disposed at the second end.

* * * * *